US007124744B2

(12) United States Patent
Weimken et al.

(10) Patent No.: US 7,124,744 B2
(45) Date of Patent: Oct. 24, 2006

(54) VARIABLE CONTROL ORIFICE MEMBER AND FUEL INJECTOR USING SAME

(75) Inventors: Norval J. Weimken, Dwight, IL (US); Xinshuang Nan, Bloomington, IL (US); Ye Tian, Bloomington, IL (US); Lifeng Wang, Normal, IL (US); Jianyuan Yang, Bloomington, IL (US); Ronald D. Shinogle, Peoria, IL (US); Chetan J. Desai, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/631,291

(22) Filed: Jul. 31, 2003

(65) Prior Publication Data

US 2005/0023372 A1 Feb. 3, 2005

(51) Int. Cl.
*F02M 37/04* (2006.01)

(52) U.S. Cl. ..... 123/496; 123/467

(58) Field of Classification Search ..... 123/467, 123/496, 506, 299, 300
See application file for complete search history.

(56) References Cited

U.S. PATENT DOCUMENTS 4,826,080 A * 5/1989 Ganser ..... 239/88
5,156,132 A 10/1992 Iwanaga
5,219,122 A * 6/1993 Iwanaga ..... 239/533.8
5,390,692 A 2/1995 Jones et al.
5,842,452 A 12/1998 Pattanaik
5,890,471 A * 4/1999 Nishimura ..... 123/496
5,893,350 A 4/1999 Timms
6,024,296 A 2/2000 Wear et al.
6,085,719 A 7/2000 Heinz et al.
6,354,271 B1 * 3/2002 Satapathy ..... 123/446
6,729,554 B1 * 5/2004 Katsura et al. ..... 239/88
6,837,221 B1 * 1/2005 Crofts et al. ..... 123/467

OTHER PUBLICATIONS

R. Racine, M. Miettaux, Y. Drutel, and J. Heidt, Application of a High Flexible Electronic Injection System to a Heavy Duty Diesel Engine, 910184, 12 pages.
Masahiko Miyaki, Hideya Fujisawa, Akira Masuda, and Yoshihisa Yamamoto, Development of New Electronically controlled Fuel Injection System ECD-U2 for Diesel Engines, 910252, 17 pages.

* cited by examiner

*Primary Examiner*—Mahmoud Gimie
(74) *Attorney, Agent, or Firm*—Liell and McNeil

(57) ABSTRACT

Engineers have determined that the ability to front end rate shape injection events can result in a number of advantages, including improved injector performance and a reduction in undesirable emissions. In addition, engineers have learned that it is desirable for the needle valve to open slowly at the beginning of an injection event and to close abruptly to end the injection event. Therefore, the present invention utilizes at least one orifice member that is movably positioned in an injector body such that fluid flowing away from the needle valve member closing hydraulic surface flows through a relatively restricted flow path and fluid flowing toward the needle valve member flow through a relatively unrestricted flow path.

20 Claims, 7 Drawing Sheets

VARIABLE CONTROL ORIFICE MEMBER AND FUEL INJECTOR USING SAME

TECHNICAL FIELD

The present invention relates generally to fuel injectors, and more particularly to fuel injectors having a direct control needle valve.

BACKGROUND

An increasing number of fuel injectors are being machined to include a direct control needle valve. In operation, a direct control needle valve is moved between an open position and a closed position by fluid displacement. For instance, the direct control needle valve to move from its closed position toward its open position, a small amount of fluid must be displaced by the needle valve. Similarly, for the needle valve to move from its open position to its closed position, a small amount of fluid must be displaced toward the needle valve. Use of direct control needle valves is desirable because they can allow for greater control over fuel injection events. Engineers have learned that the ability to better control fuel injection events can include a number of advantages, such as improved injector performance and a reduction in undesirable emissions.

In this regard, it has been learned that a fast needle valve closing is desirable to produce an abrupt end to the injection event. Conversely, it has been determined that a slow needle valve opening can increase needle valve control at the beginning of an injection event. Several attempts have been made to increase control over fuel injection events. One such attempt is disclosed in U.S. Pat. No. 6,024,296, which issued to Wear et al. on Feb. 15, 2000. Wear et al. discloses a fuel injector having a needle control passage that includes a dual flow rate orifice. While Wear et al. shows promise, there is still room for improvement.

The present invention is directed to overcoming one or more of the problems as set forth above.

SUMMARY OF THE INVENTION

In one aspect of the present invention, a fuel injector includes an injector body that defines a nozzle outlet and a needle control passage. A needle valve member is positioned in the injector body and includes a closing hydraulic surface that is exposed to fluid pressure in the needle control passage. The needle valve member is movable between an open position in which the nozzle outlet is open and a closed position in which the nozzle outlet is blocked. An orifice member is positioned in the injector body and defines a flow passage with relatively restricted flow area and is movable between a first position and a second position. The needle valve member displaces fluid through the flow passage when moving toward its open position. The needle control passage has a relatively unrestricted flow area to fluid flowing toward the closing hydraulic surface over at least a portion of movement of the needle valve member between the open position and the closed position.

In another aspect of the present invention, a method of injecting fuel includes a step of opening a nozzle outlet slowly at least in part by displacing fluid, which is caused by movement of a needle valve member, through a restricted flow passage defined by an orifice member. The nozzle outlet is quickly closed at least in part by displacing fluid toward a closing hydraulic surface of the needle valve member through an unrestricted flow passage defined at least in part by the orifice member.

DETAILED DESCRIPTION

Figure 1:
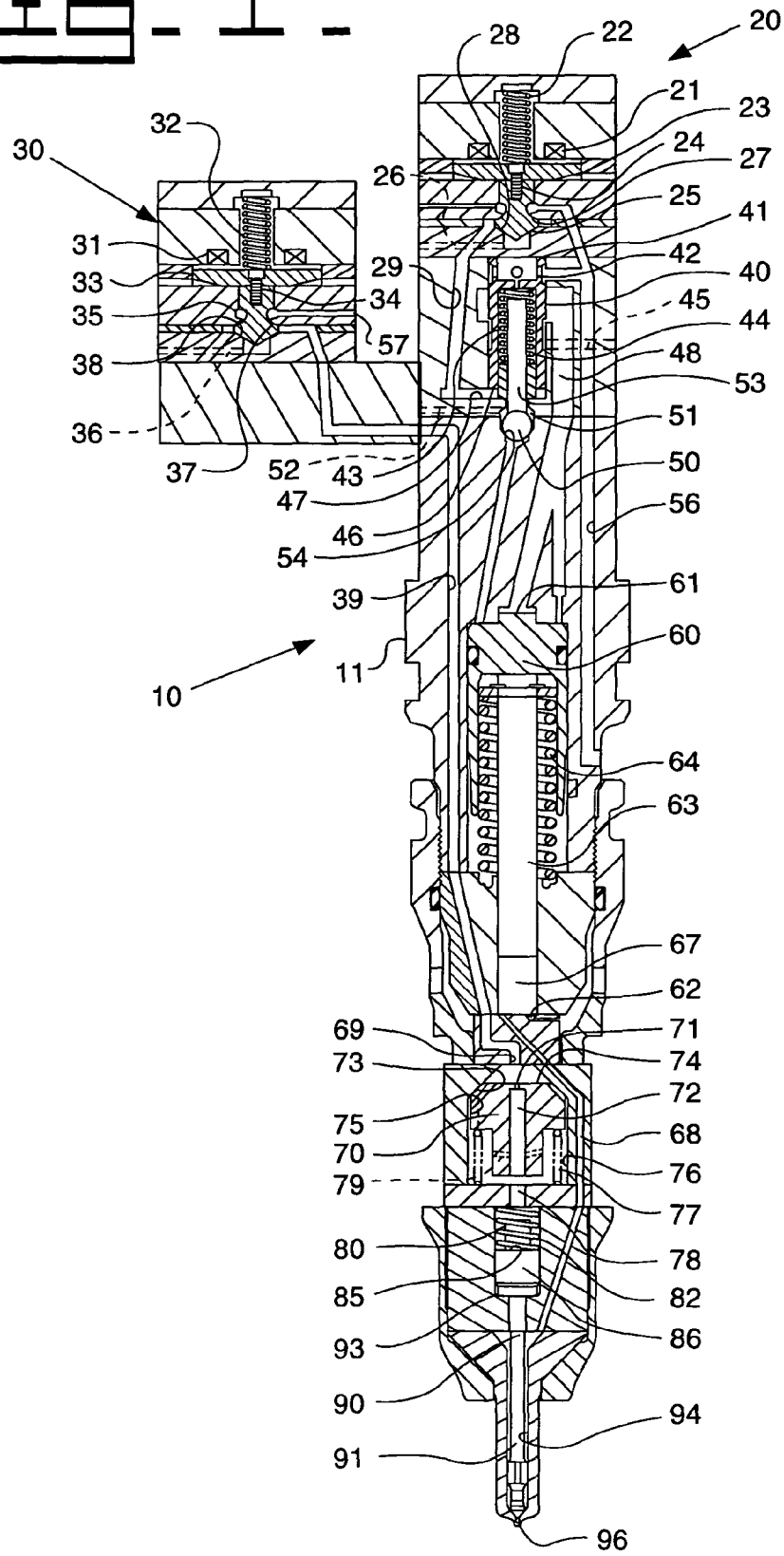
FIG. 1 is a sectioned side diagrammatic view of a fuel injector according to the present invention.

Referring now to FIG. 1 there is illustrated a fuel injector 10 according to the present invention. While fuel injector 10 has been illustrated as a hydraulically actuated, electronically controlled fuel injector, it should be appreciated that other suitable fuel injectors could be substituted. For instance, the present invention could be utilized in a mechanically actuated fuel injector or in a unit injector in a common rail fuel injection system. Fuel injector 10 includes an injector body 11 that defines a number of fluid passages and contains the various components of fuel injector 10 positioned as they would be between injection events. Fuel injector 10 includes a first electrical actuator 20 that can control pressurization of fuel for injection events and a second electrical actuator 30 that can control timing of injection events. Preferably, first electrical actuator 20 and second electrical actuator 30 are both solenoids. However, it should be appreciated that one or more suitable alternative actuators could instead be utilized. For instance, one or both of these actuators could be replaced by a piezoelectric actuator.

Electrical actuator 20 includes a coil 21, a biasing spring 22 and an armature 23. A valve member 25, such as the poppet valve illustrated in FIG. 1, is preferably operably connected to armature 23 via a fastener 24 When electrical actuator 20 is de-energized, such as between injection events, valve member 25 is held in, or moved toward, a downward, advanced position, by biasing spring 22. When valve member 25 is in this position, a high pressure seat 27 is opened and a low pressure seat 28 is blocked, such that a variable pressure passage 29 is fluidly connected to a high pressure passage 56 and blocked from fluid communication with a low pressure passage 26. When electrical actuator 20 is energized, valve member 25 is moved upward against the force of biasing spring 22 to close high pressure seat 27 and open low pressure seat 28. In this position, valve member 25 blocks variable pressure passage 29 from high pressure passage 56 and opens the same to low pressure passage 26.

Electrical actuator 30, which is preferably similar in structure to electrical actuator 20, also includes a coil 31, a biasing spring 32 and an armature 33. A valve member 35 is preferably operably connected to armature 33 via a fastener 34. When electrical actuator 30 is de-energized, such as between injection events, valve member 35 is held in, or moved toward, an advanced position by biasing spring 32. In this position, valve member 35 opens a high pressure seat 37 and closes a low pressure seat 38, such that a needle control passage 39 is open to a high pressure passage 57 and blocked from a low pressure passage 36. When electrical actuator 30 is energized, valve member 35 is pulled toward a retraced position by armature 33 against the force of biasing spring 32. In this position, valve member 35 closes high pressure seat 27 and opens low pressure seat 28, such that needle control passage 39 is blocked from high pressure passage 57 and open to low pressure passage 36.

Also positioned in injector body 11 is a spool valve member 40. Spool valve member 40 is movable between an upward, retracted position as shown, and a downward, advanced position. Spool valve member 40 is biased toward its retracted position by a biasing spring 44. Spool valve member 40 defines a high pressure annulus 42 that is always open to high pressure passage 56 and is positioned such that it can open an actuation fluid passage 48 to high pressure passage 56 when spool valve member 40 is in its advanced position. A low pressure annulus 43 is also included on spool valve member 40 that can connect actuation fluid passage 48 to a low pressure passage 45 defined by injector body 11 when spool valve member 40 is in its retracted position as shown. Spool valve member 40 has a control surface 46 that is exposed to fluid pressure in a spool cavity 47, and a biasing surface 41 that is continuously exposed to high pressure in high pressure passage 56 via a number of radial passages defined by spool valve member 40. While surfaces 41 and 46 preferably are about equal in surface area, they could alternatively be of differing surface area. Spool cavity 47 is fluidly connected to variable pressure passage 29.

When variable pressure passage 29 is open to high pressure passage 56, such as when valve member 25 is in its second position, pressure within spool cavity 47 is high and spool valve member 40 is preferably hydraulically balanced and maintained in its retracted position by biasing spring 44. When spool valve member 40 is in this position, actuation fluid passage 48 is blocked from fluid communication with high pressure passage 56 but fluidly connected to low pressure passage 45 via low pressure annulus 43. Conversely, when variable pressure passage 29 is fluidly connected to low pressure passage 45, such as when valve member 25 is in its first position, pressure within spool cavity 47 is sufficiently low that the high pressure acting on biasing surface 41 can overcome the force of biasing spring 44, and spool valve member 40 can move to its advanced position. When spool valve member 40 is in this advanced position, actuation fluid passage 48 is blocked from low pressure passage 45 but high pressure fluid can flow into actuation fluid passage 48 via high pressure annulus 42 and high pressure passage 56.

An intensifier piston 60 is positioned in injector body 11 and includes a hydraulic surface 61 that is exposed to fluid pressure in actuation fluid passage 48. Piston 60 is biased toward a retracted, upward position by a biasing spring 64. However, when pressure within actuation fluid passage 48 is sufficiently high, such as when it is open to high pressure passage 56 via high pressure annulus 42, piston 60 can move to an advanced, downward position against the action of biasing spring 64. A plunger 63 is also movably positioned in injector body 11 and moves in a corresponding manner with piston 60. When piston 60 is moved toward its advanced position, plunger 63 also advances and acts to pressurize fuel within a fuel pressurization chamber 67 that is connected to a fuel inlet past a check valve 62. During an injection event as plunger 63 moves toward its downward position, the check valve 62 is closed and plunger 63 can act to compress fuel within fuel pressurization chamber 67. When plunger 63 is returning to its upward position, fuel is drawn into fuel pressurization chamber 67 past the check valve 62. Fuel pressurization chamber 67 is fluidly connected to a fuel supply passage 68 that is defined by injector body 11. Pressurized fuel contained within fuel supply passage 68 is supplied to a nozzle supply passage 94.

Returning to fuel injector 10, a pressure relief valve 50 is movably positioned in injector body 11 to vent pressure spikes from actuation fluid passage 48. Pressure spikes can be created when piston 60 and plunger 63 abruptly stop their downward movement due to the abrupt closure of nozzle outlets 96. Because pressure spikes can sometimes cause an uncontrolled and undesirable secondary injection due to an interaction of components and passageways over a brief instant after main injection has ended, a pressure relief passage 51 extends between actuation fluid passage 48 and a low pressure vent. When spool valve member 40 is in its downward position, such as during an injection event, a pin 53 holds pressure relief ball valve member 50 downward to close a seat 54. When pressure relief valve 50 is in this position, actuation fluid passage 48 is closed to pressure relief passage 51 and pressure can build within actuation fluid passage 48. However, immediately after injection events, when piston 60 and plunger 63 are hydraulically slowed and stopped, residual high pressure in actuation fluid passage 48 can act against pressure relief valve 50. Because pressure within spool cavity 47 is high, spool valve member 40 is hydraulically balanced and can move toward its upward position under the action of biasing spring 44. Pressure relief valve 50 can then lift off of seat 54 to open actuation fluid passage 48 to pressure relief passage 51, thus allowing pressure within actuation fluid passage 48 to be vented. At the same time, upward movement of pressure relief valve 50, and therefore pin 53 can aid in the movement of spool valve member 40 toward its upward position.

Figure 2:
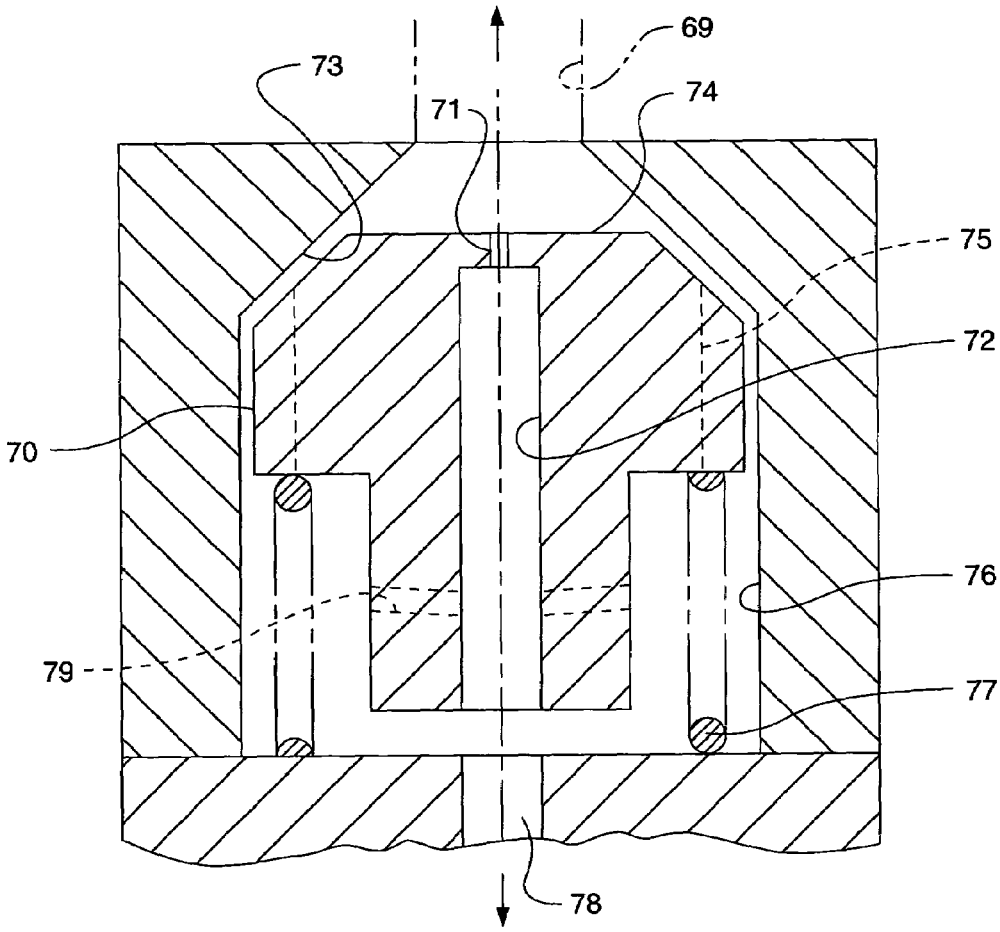
FIG. 2 is a sectioned side diagrammatic view of the orifice member of the fuel injector of FIG. 1.

Referring in addition to FIG. 2, an orifice member 70 is movably positioned in injector body 11. Orifice member 70 is preferably a variable area valve member that is positioned in needle control passage 39 and defines a portion of the same. Orifice member 70 includes a hydraulic surface 74 that is exposed to fluid pressure in an upstream portion 69 of needle control passage 39. Orifice member 70 is movable within a spring chamber 76, which is also a portion of needle control passage 39, between an upward, first position in which it closes a valve seat 73 defined by injector body 11 and a downward, second position in which valve seat 73 is opened. It should be appreciated that while valve seat 73 has been illustrated as a conical valve seat, it could also be a flat valve seat. Orifice member 70 is biased toward its first position by a biasing spring 77 that is operably positioned in injector body 11. A flow restriction orifice 71 and flow passage 72 are defined by orifice member 70. In addition, orifice member 70 defines a fluid passage 79 that fluidly connects flow passage 72 to spring chamber 76, which is a portion of needle control passage 39.

When needle control passage 39 is open to low pressure passage 36, such as during an injection event, orifice member 70 remains in its upward, biased position under the force of biasing spring 77 and the fluid pressure within spring chamber 76. However, it should be appreciated that while the fluid within spring chamber 76 is being displaced via fluid passage 79 and flow passage 72, orifice member 70 will remain in its biased position because the force of biasing spring 77 is sufficient to overcome the low pressure acting on hydraulic surface 74. When orifice member 70 is in its first position, upstream portion 69 of needle control passage 39 is fluidly connected to a downstream portion 78 of needle control passage 39 via flow passage 72, which has a relatively restricted flow area. When needle control passage 39 is opened to high pressure passage 57, orifice member 70 will be abruptly moved to its second position against the force of biasing spring 77 due to the increased hydraulic force acting on hydraulic surface 74. When orifice member 70 is in its second position, upstream portion 69 is fluidly connected to downstream portion 78 via both flow passage 72 and a relatively unrestricted flow passage 75, a portion of which is an annular flow area between orifice member 70 and injector body 11. Thus, when orifice member 70 is in its second position, needle control passage 39 has a relatively unrestricted flow area, which includes flow passage 72 and unrestricted flow passage 75. However, as high pressure fluid flows into spring chamber 76 via fluid passage 79, the pressure within spring chamber 76 will increase, causing orifice member 70 to be returned to its first position.

Returning to FIG. 1, a direct control needle valve 90 is movably positioned in injector body 11. Direct control needle valve 90 preferably includes a piston portion 86 and a needle valve member 91. Piston portion 86 includes a closing hydraulic surface 85 that is exposed to fluid pressure in a needle control chamber 80, while needle valve member 91 includes an opening hydraulic surface 93 that is exposed to fluid pressure in nozzle supply passage 94. Needle valve member 91 is movable between a biased, closed position and an open position. When valve member 35 is in its advanced position, such as when electrical actuator 30 is de-energized, high pressure fuel can act on closing hydraulic surface 85 via both flow passage 72 and unrestricted flow passage 75. Thus, needle valve member 91 is maintained in its downward, closed position. When valve member 35 is moved to its retracted position, needle control passage 39, and therefore needle control chamber 80, becomes blocked from high pressure passage 57 and connected to low pressure passage 36. With high pressure no longer acting on closing hydraulic surface 85, needle valve member 91 can be lifted to its upward, open position by the force of pressurized fuel acting on opening hydraulic surface 93. It should be appreciated that when orifice member 70 is in its second position, needle control passage 39 will have a relatively unrestricted flow area to fluid flowing toward closing hydraulic surface 85 over at least a portion of the movement of needle valve member 91 between its open and closed positions.

Closing hydraulic surface 85 and opening hydraulic surface 93 are preferably sized such that even when a valve opening pressure is attained in nozzle supply passage 94, needle valve member 91 will not lift open when needle control chamber 80 is fluidly connected to high pressure passage 57 via needle control passage 39. However, it should be appreciated that the relative sizes of closing hydraulic surface 85 and opening hydraulic surface 93 and the strength of biasing spring 82 should be such that when closing hydraulic surface 85 is no longer exposed to high pressure in needle control chamber 80, a valve opening pressure acting on opening hydraulic surface 93 should be sufficient to move needle valve member 91 upward against the force of biasing spring 82 to open nozzle outlet 96. It should be further appreciated that the strength of biasing spring 82 should be such that needle valve member 91 will remain in its closed position when fuel pressure in nozzle supply passage 94 is below a valve opening pressure, even when needle control chamber 80 is fluidly connected to low pressure passage 36 via needle control passage 39.

In addition to these considerations, it should be appreciated that flow restriction orifice 71 should be large enough that needle valve member 91 can displace a sufficient amount of fluid via flow passage 72 to move toward its open position when orifice member 70 is in its first position. However, flow restriction orifice 71 should still be sufficiently small that flow passage 72 is a relatively restricted flow passage. Thus, when orifice member 70 is in its first position and needle control passage 39 is opened to low pressure passage 36, high pressure actuation fluid in needle control chamber 80 and needle control passage downstream portion 78 will be displaced relatively slowly through flow passage 72 and flow restriction orifice 71. Therefore, because fluid is being displaced at a reduced rate within needle control chamber 80, needle valve member 91 will be lifted toward its open position slowly. In other words, once the valve opening pressure is reached in nozzle supply passage 94, needle valve member 91 will be lifted slowly toward its open position. Thus, fuel pressure at nozzle outlet 96 will be increasing for a majority of time between the opening of needle valve member 91 and the closing of needle valve member 91. However, when needle control passage 39 is re-opened to high pressure passage 57, high pressure fluid will act on hydraulic surface 74 and move orifice member 70 toward its second position. Thus it should be appreciated that because needle control chamber 80 will be open to high pressure passage 57 via a relatively unrestricted flow path at this time, the injection event can end abruptly, which is desirable.

Figure 3:
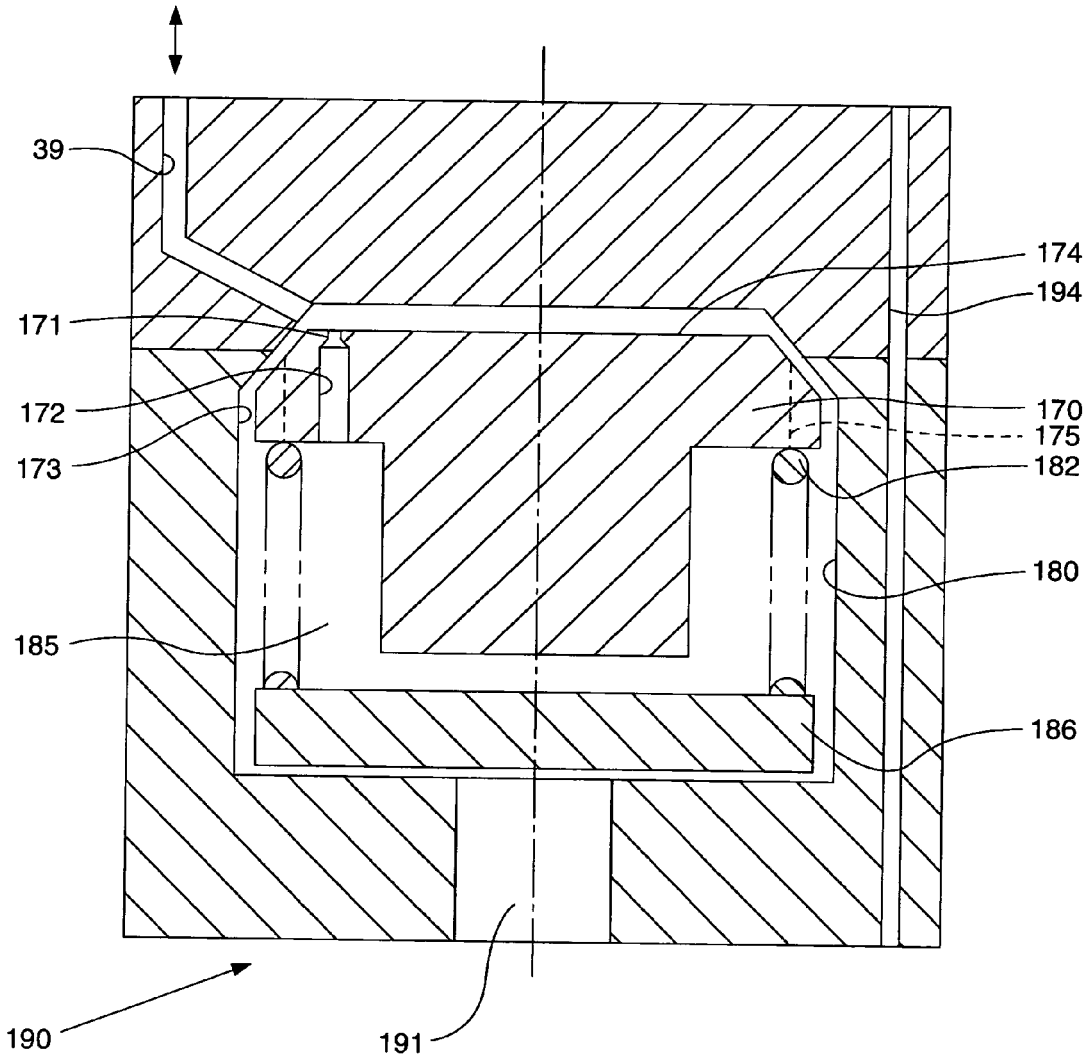
FIG. 3 is a sectioned side diagrammatic view of an orifice member for use with the fuel injector of FIG. 1 according to another embodiment of the present invention.

Referring now to FIG. 3, an orifice member 170 is illustrated according to an alternate embodiment of the present invention. It should be appreciated that with minor modification of fuel injector 10 illustrated in FIG. 1, orifice member 170 could be positioned within injector body 11 to make a complete injector. Orifice member 170 includes a flow restriction orifice 171 and a flow passage 172 and defines a portion of needle control passage 39. As with orifice member 70, illustrated in FIGS. 1 and 2, orifice member 170 is also movable between an upward, first position and a downward, second position and is biased toward its first position by a biasing spring 182 that is operably positioned within injector body 11. However, unlike the embodiment illustrated in FIGS. 1 and 2, orifice member 170 is positioned in needle control chamber 180. Thus, as illustrated in FIG. 3 biasing spring 182 is common biaser that is compressed between orifice member 170 and piston portion 186 of direct control needle valve 190 and acts to bias orifice member 170 toward its first position while biasing needle valve member 191 toward its closed position.

When needle control passage 39 is open to low pressure passage 36, such as during an injection event, orifice member 170 will remain in its upward, biased position under the force of biasing spring 182 and the fluid pressure within needle control passage 180. However, it should be appreciated that while the fluid within needle control chamber 180 is being displaced via flow passage 172, orifice member 170 will remain in its first position. When orifice member 170 is in its first position, a conical valve seat 173 defined by injector body 11 is closed. Thus, needle control chamber 180 is open to needle control passage 39 via only restricted area flow passage 172. When needle control passage 39 is opened to high pressure passage 57, orifice member 170 will be abruptly moved to its second position against the force of biasing spring 182. When orifice member 170 is in its second position, valve seat 173 is opened and needle control chamber 180 is open to needle control passage 39 via flow passage 172 and an unrestricted flow passage 175. Thus, a closing hydraulic surface 185 of needle valve 190 is exposed to high pressure fluid via a relatively unrestricted flow passage when orifice member 170 is in its second position. As with the previous embodiment, when orifice member 170 is in its second position, needle control passage 39 is opened to needle control chamber 180 via an unrestricted flow area that includes both unrestricted flow passage 175, which is a portion of the annular flow area between orifice member 170 and injector body 11, and flow passage 172. However, as with the previous embodiment, it should be appreciated that as high pressure fluid flows into needle control chamber 180 via flow passage 172, the pressure within needle control chamber 180 will increase, thus causing orifice member 170 to be returned to its first position in preparation for the next injection event. In addition, it should be appreciated that direct control needle valve 190 could be composed of two or more pieces, as illustrated, or it could instead be composed of a single component.

It should be appreciated that flow restriction orifice 171 should be large enough that needle valve member 191 can displace a sufficient amount of fluid via flow passage 172 to move toward its open position when orifice member 170 is in its first position. However, flow restriction orifice 171 should still be sufficiently small that flow passage 172 is a relatively restricted flow passage. Thus, when orifice member 170 is in its first position and needle control passage 39 is opened to low pressure passage 36, high pressure actuation fluid needle control chamber 180 will drain relatively slowly through flow passage 172 and flow restriction orifice 171. Therefore, because fluid within needle control chamber 180 is being displaced through restricted flow passage 172, needle valve member 191 will be lifted toward its open position slowly. In other words, once the valve opening pressure is reached in nozzle supply passage 194, needle valve member 191 will be lifted slowly toward its open position. However, when needle control passage 39 is reopened to high pressure passage 57, high pressure fluid will act on hydraulic surface 174 and move orifice member 170 toward its second position. Thus it should be appreciated that because needle control chamber 180 will be open to high pressure passage 57 via a relatively unrestricted flow path at this time, the injection event can end abruptly, which is desirable.

Figure 4:
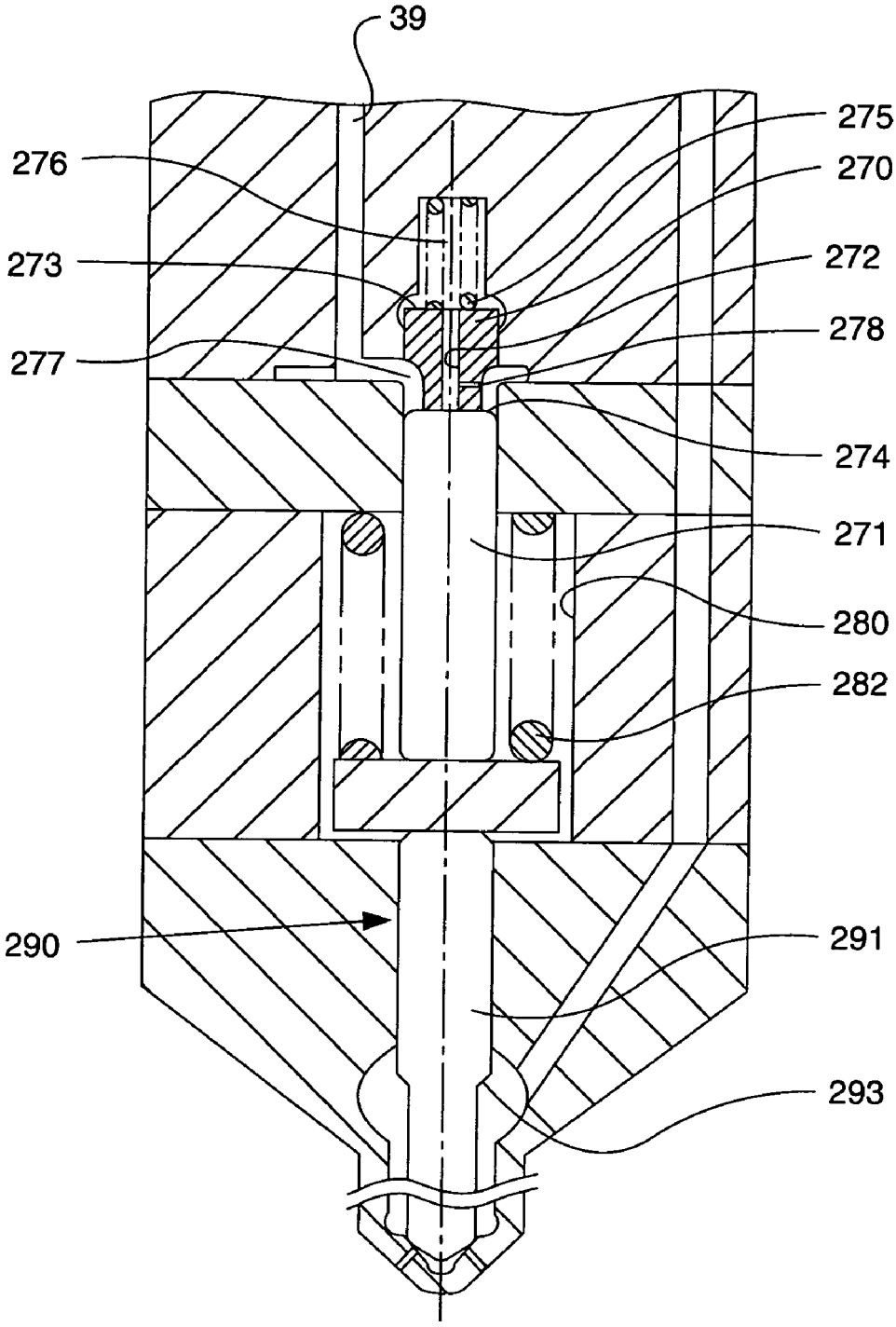
FIG. 4 is a sectioned side diagrammatic view of an orifice member for use with the fuel injector of FIG. 1 according to yet another embodiment of the present invention.

Referring now to FIG. 4, there is illustrated an orifice member according to yet another embodiment of the present invention. Orifice member 270 is movably positioned within injector body 11. It should be appreciated that with minor modifications to fuel injector 10, the orifice member illustrated in FIG. 5 could be incorporated to make a complete injector. Orifice member 270 is movable between an upward first position and a downward second position and is biased toward its second position by a biasing spring 275. As illustrated, orifice member 270 defines a flow restriction orifice 278 and a flow passage 272 that fluidly connect a first cavity 276 with a second cavity 277. Orifice member 270 includes a first hydraulic surface 273 that is exposed to fluid pressure within first cavity 276, which also contains biasing spring 275. A check control piston 271 is also movable between an upward first position and a downward second position and is positioned between orifice member 270 and a direct control needle valve 290. Direct control needle valve 290 includes a needle valve member 291 and is biased toward a closed position by a biasing spring 282 that is positioned in a spring chamber 280. Check control piston 271 includes a second hydraulic surface 274, which functions as a closing hydraulic surface for needle valve 290, that is exposed to fluid pressure within second cavity 277.

When needle control passage 39 is opened to low pressure passage 36, such as at the beginning of an injection event, the fluid within a second cavity 277 is displaced rapidly. However, because first cavity 276 is fluidly connected to second cavity 277, and therefore needle control passage 39, via a relatively restricted flow path that includes flow restriction orifice 278 the fluid within first cavity 276 will be displaced slowly. As the fluid within first cavity 276 is slowly displaced, a valve opening pressure can be attained within nozzle supply passage 94. Once the valve opening pressure is reached, needle valve member 291 can be lifted toward its open position fluidly connecting nozzle outlet 96 to nozzle supply passage 94. It should be appreciated that for this embodiment of the present invention, the valve opening pressure is the pressure sufficient to lift needle valve member 291, check control piston 271 and orifice member 270 against the downward force of biasing springs 275 and 282 and the fluid pressure within first cavity 276 that is acting on first hydraulic surface 273.

When needle control passage 39 is first opened to high pressure passage 57, such as just prior to the desired end of the injection event, high pressure can act on closing hydraulic surface 274 to move check control piston 271, and therefore needle valve member 291 toward their respective downward positions. Because needle control passage 39 is a relatively unrestricted flow path between high pressure passage 57 and second cavity 277, check control piston 271 and needle valve member 291 can be moved toward their downward, closed positions in an abrupt manner. However, it should be appreciated that orifice member 270 will not immediately move toward its downward position, but will remain relatively stationary in its upward position as needle valve member 291 closes nozzle outlet 96. Once the fluid pressure acting on first hydraulic surface 273, combined with the biasing force of biasing spring 275, overcomes the force of high pressure fluid in second cavity 277, orifice member 270 will be returned to its downward position in contact with check control piston 271.

It should be appreciated that the various sizes and strengths of first hydraulic surface 273, closing hydraulic surface 274, biasing spring 275 and biasing spring 282 should be such that even when a valve opening pressure is attained in nozzle supply passage 94, needle valve member 291 will not lift to its open position when first orifice member 270 is in its downward position and first cavity 276 is open to high pressure passage 57 via flow restriction orifice 278 and flow passage 272. However, the relative sizes of closing hydraulic surface 274 and opening hydraulic surface 293 and the strength of biasing spring 282 should be such that when closing hydraulic surface 274 is no longer exposed to high pressure in second cavity 277, a valve opening pressure acting on opening hydraulic surface 293 should be sufficient to move needle valve member 291 upward against the force of biasing spring 282, biasing spring 275 and the fluid pressure within first cavity 276 to open nozzle outlet 96. It should be further appreciated that the strength of biasing springs 275 and 282 should be such that needle valve member 291 will remain in its closed position when fuel pressure in nozzle supply passage 94 is below a valve opening pressure, even when second cavity 277 is fluidly connected to low pressure passage 36 via needle control passage 39.

In addition to these considerations, it should be appreciated that flow restriction orifice 278 should be large enough that orifice member 270 can displace a sufficient amount of fluid via needle control passage 39 that needle valve member 291 can move toward its open position when fluid within first cavity 276 is being displaced. However, flow restriction orifice 278 should still be sufficiently small that a relatively restricted flow passage exists between first cavity 276 and needle control passage 39. Thus, when orifice member 270 is in its downward position and needle control passage 39 is opened to low pressure passage 36, high pressure actuation fluid in first cavity 276 will drain relatively slowly through flow restriction orifice 278. Therefore, because fluid is being displaced from first cavity 276 via a flow restriction, needle valve member 291 will be lifted toward its open position slowly. In other words, once the valve opening pressure is reached in nozzle supply passage 94, needle valve member 291 will be lifted slowly toward its open position. Thus, as with the previous embodiments, fuel pressure at nozzle outlet 96 will be increasing for a majority of time between the opening of needle valve member 291 and the closing of needle valve member 291. However, when needle control passage 39 is re-opened to high pressure passage 57, high pressure fluid will act on closing hydraulic surface 274 and move check control piston 271 toward its downward position. Thus it should be appreciated that because second cavity 277 is open to high pressure passage 57 via a relatively unrestricted flow path, the injection event can end abruptly, which is desirable.

Figure 5:
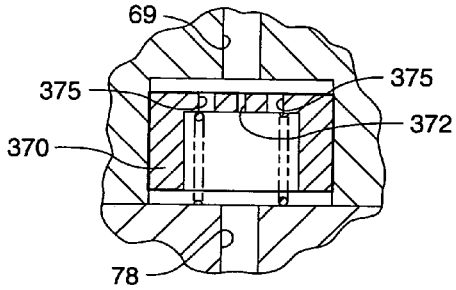
FIG. 5 is a sectioned side diagrammatic view of an orifice member for use with the fuel injector of FIG. 1 according to still another embodiment of the present invention.
Figure 6:
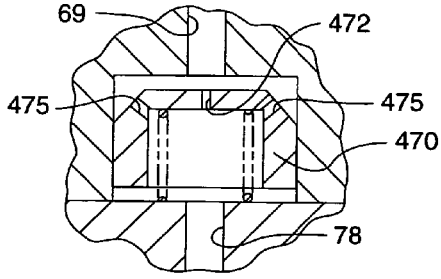
FIG. 6 is a sectioned side diagrammatic view of an orifice member for use with the fuel injector of FIG. 1 according to yet another embodiment of the present invention.

It should be appreciated that various modifications could be made to the embodiments of the present invention disclosed herein. For instance, recall that the FIG. 2 embodiment of the present invention, while the unrestricted flow passage has been illustrated as including a relatively restricted flow passage defined by the orifice member and the annular area around the orifice member. Alternatively, the orifice member could define a restricted flow passage and one or more unrestricted flow passages. Referring in addition to FIG. 5, an orifice member 370 is illustrated including a restricted flow passage 372 and two unrestricted flow passages 375. When orifice member 370 is in its first position, only restricted flow passage 372 fluidly connects upstream portion 69 of needle control passage 39 to downstream portion 78. However, when orifice member 370 is in the second position, a relatively unrestricted flow path including restricted flow passage 372 and unrestricted flow passages 375 fluidly connect upstream portion 69 to downstream portion 78. While the orifice member 370 illustrated in FIG. 5 includes a flat, top surface, the orifice member could instead include an annular top surface. For instance, referring to FIG. 6, and orifice member 470 has been illustrated that is similar to orifice member 370. Orifice member 470 defines a restricted flow passage 472 that opens at the flat top surface of orifice member 470. However, unlike orifice member 370, orifice member 470 defines unrestricted flow passages 475 that open at an annular portion of the top surface of orifice member 470.

Figure 7:
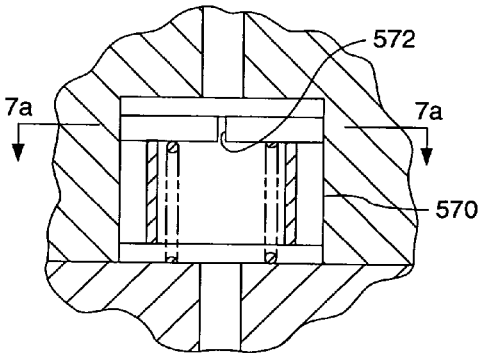
FIG. 7 is a sectioned side diagrammatic view of an orifice member for use with the fuel injector of FIG. 1 according to still another embodiment of the present invention.
Figure 8:
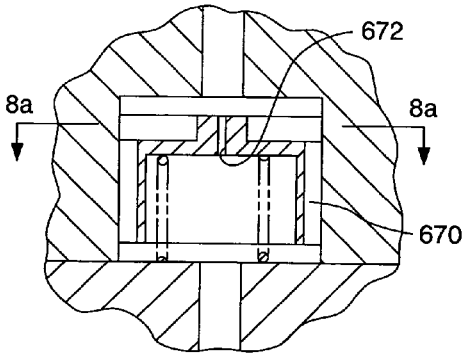
FIG. 8 is a sectioned side diagrammatic view of an orifice member for use with the fuel injector of FIG. 1 according to yet another embodiment of the present invention.
Figure 7A:
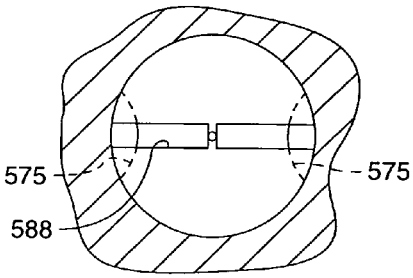
Figure 8A:
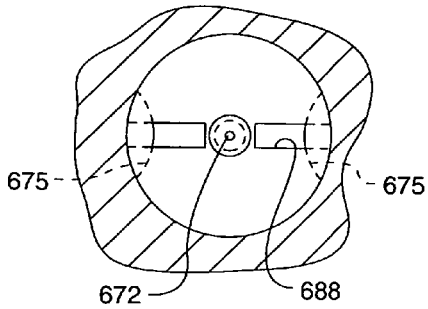

In addition to these modifications, the present invention could be modified as illustrated in FIGS. 7 and 8. Referring to FIGS. 7 and 7*a*, an orifice member 570 has been illustrated that defines a restricted flow passage 572 that is fluidly connected to needle control passage 39 at all times. In addition, orifice member 570 defines two slots 588 that can open upstream portion 69 of needle control passage 39 to downstream portion 78 via unrestricted flow passages 575 when orifice member 572 is away from its upward position. Similarly, in FIGS. 8 and 8*a*, an orifice member 670 has been illustrated that defines a restricted flow passage 672 that can fluidly connect upstream portion 69 to downstream portion 78 regardless of the position of orifice member 670. Orifice member 670 also defines slots 688 that can fluidly connect upstream portion 69 to downstream portion 78 via unrestricted flow passages 675 when orifice member 670 is away from its upward position. As illustrated, the slots can be fluidly connected to the restricted flow passage, as illustrated in the FIG. 7 embodiment, or they can be blocked from fluid communication with the restricted flow passage, as illustrated in FIG. 8.

Figure 9:
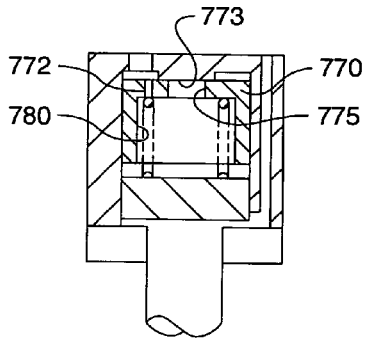
FIG. 9 is a sectioned side diagrammatic view of an orifice member for use with the fuel injector of FIG. 1 according to still another embodiment of the present invention.
Figure 11:
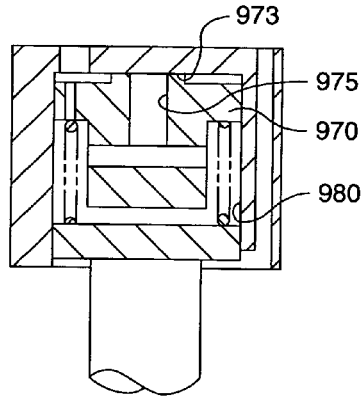
FIG. 11 is a sectioned side diagrammatic view of an orifice member for use with the fuel injector of FIG. 1 according to still another embodiment of the present invention.
Figure 10:
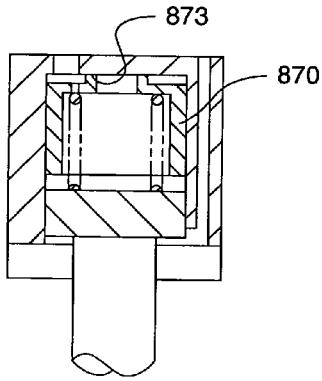
FIG. 10 is a sectioned side diagrammatic view of an orifice member for use with the fuel injector of FIG. 1 according to yet another embodiment of the present invention.

In addition to these modifications, while the orifice members of the present invention have been illustrated closing conical valve seats, it should be appreciated that the valve seats could also be flat. For instance, as illustrated in FIG. 9, an orifice member 770 has been illustrated in its upward position within a needle control chamber 780. When orifice member 770 is in this position, needle control passage 39 is open to needle control chamber 780 only via a restricted flow passage 772 defined by orifice member 770. In addition, when orifice member 770 is in this position, a flat valve seat 773, defines by injector body 11, is closed by orifice member 770. However, when orifice member 770 is away from this position, needle control passage 39 is open to needle control chamber 780 via both restricted flow passage 772 and an unrestricted flow passage 775, defined by orifice member 770. While valve seat 773 has been illustrated as a portion of a protrusion that extends from injector body 11 in the FIG. 9 embodiment, another alternative of a flat valve seat has been illustrated in FIG. 10. Note that in FIG. 10, valve seat 873 is closed by a raised portion of orifice member 870 when orifice member 870 is in its upward position. In addition, the FIG. 10 embodiment could be further modified to be a variable area orifice member 970, as illustrated in FIG. 11. Note that orifice member 970 defines an unrestricted passage 975 that is a T-passage that fluidly connects needle control passage 39 to needle control chamber 980 when orifice member 970 is away from its upward position.

Figure 12:
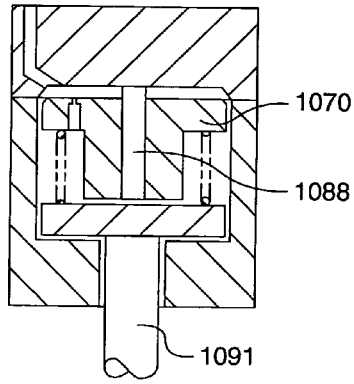
FIG. 12 is a sectioned side diagrammatic view of an orifice member for use with the fuel injector of FIG. 1 according to yet another embodiment of the present invention.
Figure 13:
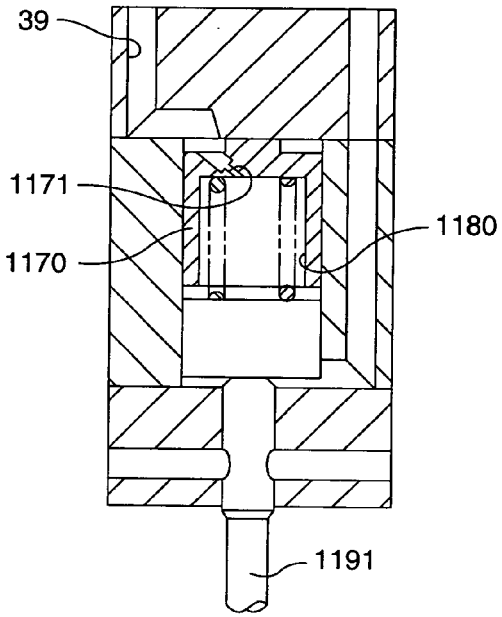
FIG. 13 is a sectioned side diagrammatic view of an orifice member for use with the fuel injector of FIG. 1 according to another embodiment of the present invention.
Figure 14:
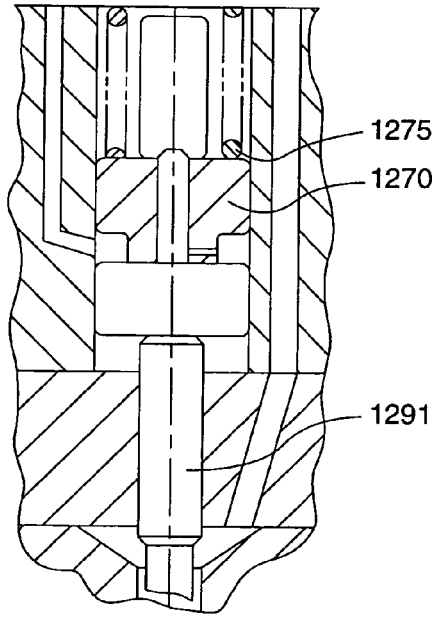
FIG. 14 is a sectioned side diagrammatic view of an orifice member for use with the fuel injector of FIG. 1 according to still another embodiment of the present invention.

In addition to these modifications, and referring to the FIG. 3 embodiment, orifice member 170 could be modified as illustrated in FIG. 12. Note that orifice member 1070, illustrated in FIG. 12, is movable between an upward position and a downward position about a pin 1088. Pin 1088 might be desirable to prevent orifice member 1070 from contacting needle valve member 1091 when these components are moving toward each other. Additionally, the present invention could be modified as illustrated in FIG. 13. Orifice member 1170, illustrated in FIG. 13, includes a dual flow rate orifice 1171. By appropriately sizing and shaping dual flow rate orifice 1171, high pressure fluid flowing into needle control chamber 1180 from needle control passage 39 will be relatively unrestricted. However, fluid flow from needle control chamber 1180 to needle control passage 39, such as when needle valve member 1191 is moving toward its upward position, will be relatively restricted. Further, the FIG. 4 embodiment could be modified as illustrated in FIG. 14. Note that unlike the FIG. 4 embodiment, a single biasing spring 1275 biases orifice member 1270 and needle valve member 1291 toward their downward positions.

INDUSTRIAL APPLICABILITY

Referring now to FIGS. 1 and 2, just prior to an injection event, low pressure prevails in fuel injector 10, valve member 35 is in its biased position opening needle control passage 39 to high pressure passage 57, valve member 25 is in its biased position opening variable pressure passage 29 to high pressure passage 56, and spool valve member 40 is hydraulically balanced and positioned in its retracted position opening actuation fluid passage 48 to low pressure passage 45. Orifice member 70 is in its advanced, first position such that needle control chamber 80 is open to needle control passage 39 via only restricted flow orifice 71 and needle valve member 91 is held in its downward, closed position by biasing spring 82. Prior to the initiation of an injection event, electrical actuator 20 is energized to begin fuel pressurization within fuel injector 10.

When electrical actuator 20 is energized, valve member 25 is pulled toward its retracted position by armature 23. Variable pressure passage 29, and thus spool cavity 47, is now blocked from high pressure passage 56 and opened to low pressure passage 26. With low pressure acting on control surface 46 in spool cavity 47, spool valve member 40 is moved toward its advanced position as a result of the high pressure acting on biasing surface 41. Actuation fluid passage 48 is now opened to high pressure passage 56. High pressure actuation fluid flowing into actuation fluid passage 48, acts on hydraulic surface 61 of piston 60, causing piston 60 and plunger 63 to begin to move toward their advanced positions to pressurize fuel in fuel pressurization chamber 67 and nozzle supply passage 94. However, because closing hydraulic surface 85 is also exposed to high pressure in needle control chamber 80 via needle control passage 39, needle valve member 91 will not be moved to its upward position to open nozzle outlet 96. Further, it should be appreciated that piston 60 and plunger 63 move only a slight distance at this time because of hydraulic locking, which is a result of nozzle outlet 96 remaining closed. However, the slight movement of piston 60 and plunger 63 is still sufficient to raise fuel pressure within fuel pressurization chamber 67 to injection pressure levels.

Just prior to the desired start of injection, electrical actuator 30 is energized and valve member 35 is pulled toward its upward position by armature 33. Needle control passage 39 is now blocked from high pressure passage 57 and opened to low pressure passage 36. However, because orifice member 70 is in its upward, first position, downstream portion 78 of needle control passage 39 is opened to low pressure passage 36 only via a restricted flow path. Once the pressure acting on opening hydraulic surface 93 exceeds a valve opening pressure, needle valve member 91 begins moving toward its upward position, and fuel spray into the combustion space can commence. However, because fluid within needle control chamber 80 is being displaced slowly, the opening of needle valve member 91 is slowed. Thus, nozzle outlet 96 is opened slowly by fluid displacement through a restricted flow passage including flow passage 72 defined by orifice member 70, as a result of movement of needle valve member 91 toward its open position. Because low pressure is acting on hydraulic surface 74, orifice member 70 will remain stationary in its biased, first position while needle valve member 91 moves from its closed position to its open position. Thus, fluid within needle control chamber 80 is displaced slowly. In addition, fluid within spring chamber 76 will be displaced via fluid passage 79 and flow passage 72.

When the desired amount of fuel has been injected by fuel injector 10, electrical actuator 30 is de-energized and valve member 35 is returned to its downward position by biasing spring 32. Needle control passage 39 is re-opened to high pressure passage 57. With high pressure acting on hydraulic surface 74, orifice member 70 is moved toward its second, downward position against the action of biasing spring 77. Once orifice member 70 moves from its first, restricted position to its second, unrestricted position, valve seat 73 is opened. Downstream portion 78 of needle control passage 39 is now fluidly connected to high pressure passage 57 via both flow passage 72 and unrestricted flow path 75. Thus, fluid can be displaced toward needle control chamber 80 in an abrupt manner. Once the pressure acting on closing hydraulic surface 85 exceeds a valve closing pressure, needle valve member 91 is returned to its downward position closing nozzle outlet 96 to end the injection event. Therefore, nozzle outlet 96 is closed quickly as a result of fluid displacement toward closing hydraulic surface 85 via an unrestricted flow passage that includes both flow passage 72 and unrestricted flow passage 75. Once nozzle outlet 96 is closed, piston 60 and plunger 63 end their downward movement as a result of hydraulic locking. However, these components do not immediately begin to retract because hydraulic surface 61 is still exposed to high pressure fluid in actuation fluid passage 48. It should be appreciated that if a split injection is desired, electrical actuator 30 would be re-energized and valve member 35 would be returned to its upward position fluidly connecting needle control passage 39 to low pressure passage 36.

Once the injection event has ended, the various components of fuel injector 10 reset themselves in preparation for the following injection event. As high pressure actuation fluid flows into spring chamber 76 via fluid passage 79, pressure within spring chamber 76 increases, causing orifice member 70 to be returned to its first position. Electrical actuator 20 is de-energized and valve member 25 is returned to its downward position under the force of biasing spring 22 to open variable pressure passage 29 is now open to high pressure passage 56. Control surface 46 is exposed to high pressure within spool cavity 47. Once nozzle outlet 96 is closed, residual high pressure in actuation fluid passage 48 is sufficient to move pressure relief valve 50 upward away from seat 54 to fluidly connect actuation fluid passage 48 to pressure relief passage 51. Pressure relief valve 51 can therefore help vent high pressure actuation fluid from actuation fluid passage 48 to prevent pressure spikes from causing undesired secondary injections. At the same time, the upward movement of pressure relief valve 50 causes pin 53 to aid spool valve member 40 in returning to its upward position. Recall that control surface 46 is again exposed to high pressure in spool cavity 47, causing spool valve member 40 to once again be hydraulically balanced such that it can return to its upward position under the force of biasing spring 44, in addition to the upward force of pin 53. When spool valve member 40 begins to retract, piston 60 and plunger 63 end their downward movement, however, as a result of hydraulic locking they do not immediately begin to retract. Once spool valve member 40 is returned to its upward position, actuation fluid passage 48 is blocked from fluid communication with high pressure passage 56 and fluidly connected to low pressure passage 45, which further reduces the pressure within actuation fluid passage 48. Piston 60 and plunger 63 can now move toward their retracted positions. As plunger 63 retracts, fuel can be drawn into fuel pressurization chamber 67.

Referring now to the embodiment illustrated in FIG. 3, prior to an injection event, electrical actuator 20 is energized, variable pressure passage 29 is fluidly connected with low pressure passage 26 by the movement of valve member 25, actuation fluid passage 48 is fluidly connected to high pressure passage 56 by the movement of spool valve member 40, and piston 60 and plunger 63 move slightly toward their advanced positions pressurize fuel within fuel pressurization chamber 67. Just prior to an injection event, electrical actuator 30 is energized and valve member 35 is pulled toward its upward position by armature 33. Needle control passage 39 is now fluidly connected to low pressure passage 36 and high pressure actuation fluid within needle control chamber 180 can be drained via flow passage 172 and flow restriction orifice 171. Once a valve opening pressure is reached in nozzle supply passage 94, needle valve member 191 is lifted toward its upward position and fuel spray into the combustion space can commence. However, once again, because fluid within needle control chamber 180 is being displaced slowly via a restricted flow path, the opening of needle valve member 191 is not abrupt.

Once the desired amount of fuel has been injected by fuel injector 10, electrical actuator 30 is de-energized and valve member 35 is returned to its downward position by biasing spring 32, re-opening needle control passage 39 to high pressure passage 57. With high pressure acting on hydraulic surface 174, orifice member 170 is moved toward its second, downward position against the action of biasing spring 182. Once orifice member 170 opens valve seat 173, needle control chamber 180 is fluidly connected to high pressure passage 57 via both flow passage 172 and unrestricted flow path 175. Thus, fluid is quickly displaced toward needle control chamber 180. The dramatic increase in pressure that results from this large fluid displacement, together with the action of orifice member 170 against biasing spring 182, causes needle valve member 191 to be moved to its downward position to end the injection event. Once the injection event is ended, the various components of fuel injector 10 reset themselves in the manner described for the FIGS. 1 and 2 embodiment of the present invention.

Referring now to the FIG. 4 embodiment, prior to an injection event, orifice member 270 and check control piston 271 are in contact and in their respective downward positions. Needle valve member 291 is held in its downward position closing nozzle outlet 96 by biasing spring 282, check control piston 271, orifice member 270 and biasing spring 275. Prior to the desired start of the injection event, electrical actuator 20 is energized, variable pressure passage 29 is fluidly connected with low pressure passage 26 by the movement of valve member 25, actuation fluid passage 48 is fluidly connected to high pressure passage 56 by the movement of spool valve member 40, and piston 60 and plunger 63 move slightly toward their advanced positions pressurize fuel within fuel pressurization chamber 67. Just prior to an injection event, electrical actuator 30 is energized and valve member 35 is pulled toward its upward position by armature 33. Needle control passage 39 is now fluidly connected to low pressure passage 36.

When needle control passage 39 is opened to low pressure passage 36, pressure within second cavity 277 is dramatically reduced. However, orifice member 270, check control piston 271 and needle valve member 291 remain in their respective downward positions as a result of the downward force of both biasing spring 275 and the high pressure fluid acting on first hydraulic surface 273 in first cavity 276. However, because first cavity 276 is fluidly connected to needle control passage 39, and therefore low pressure passage 36, via flow restriction orifice 278, fluid within first cavity 276 is slowly displaced. As high pressure fluid within first cavity 276 is slowly displaced via flow passage 272 and flow restriction orifice 278, the fuel pressure acting on opening hydraulic surface 293 within nozzle supply passage 94 begins to approach a valve opening pressure. Once a valve opening pressure is attained, needle valve member 291 is lifted toward its open position against the force of biasing springs 275 and 282. As fluid within first cavity 276 continues to be slowly displaced, needle valve member 291 slowly moves toward its upward, open position.

Once the desired amount of fuel has been injected by fuel injector 10, electrical actuator 30 is de-activated and valve member 35 is returned to its biased position fluidly connecting needle control passage 39 to high pressure passage 57. Once needle control passage 39 is opened to high pressure passage 57, high pressure can act on closing hydraulic surface 274 to move check control piston 271 toward its downward position. As check control piston 271 moves downward, needle valve member 291 is moved to close nozzle outlet 96 and end the injection event. Because second cavity 277 is open to high pressure passage 57 via a relatively unrestricted flow passage, needle control passage 39, the closing of needle valve member 291 is abrupt, as opposed to the slowed opening of needle valve member 291 that is facilitated by flow restriction orifice 278. Once the injection event has ended, electrical actuator 20 is de-energized and the various components of fuel injector 10 reset themselves in preparation for the subsequent injection event.

Further, in addition to the modifications to the present invention illustrated previously, and as indicated previously, it should be appreciated that while a hydraulically actuated fuel injector has been illustrated, the present invention would find application with a mechanically actuated fuel injector or with a unit injector included in a common rail fuel injection system. Further, those skilled in the art will appreciate that for a hydraulically actuated fuel injector, any suitable actuation fluid could be used, such as engine lubricating oil, fuel or coolant fluid.

It should be understood that the above description is intended for illustrative purposes only, and is not intended to limit the scope of the present invention in any way. Thus, those skilled in the art will appreciate that other aspects, objects and advantages of this invention can be obtained from a study of the drawings, the disclosure and the appended claims.

What is claimed is:

1. A fuel injector comprising:

an injector body defining a nozzle outlet and a needle control passage;

a needle valve member positioned in said injector body and including a closing hydraulic surface exposed to fluid pressure in said needle control passage, and being movable between an open position in which said nozzle outlet is open, and a closed position in which said nozzle outlet is blocked;

an orifice member positioned in said injector body and defining a flow passage with a minimum flow area along its lenght, which is a restricted flow area, and being movable between a first position and a second position;

said needle valve member displacing fluid through said flow passage when moving toward said open position; and said needle control passage having a minimum flow area along its lenght, which is an unrestricted flow area, and fluid being displaced through said unrestricted flow area toward said closing hydraulic surface over at least a portion of movement of said needle valve member between said open position and said closed position.

2. The fuel injector of claim 1 wherein said orifice member defines a portion of said needle control passage.

3. The fuel injector of claim 2 including a compressed spring operably positioned in said injector body to bias said orifice member toward one or said first position and said second position.

4. The fuel injector of claim 3 wherein said compressed spring is also operably coupled to bias said needle valve member toward said closed position.

5. The fuel injector of claim 4 wherein said spring is compressed between said needle valve member and said orifice member.

6. The fuel injector of claim 2 wherein said orifice member is a variable area valve member;

said flow passage fluidly connects an upstream portion of said needle control passage to a downstream portion of said needle control passage when said variable area valve member is in said first position; and said needle control passage has a relatively unrestricted flow area when said variable area valve member is in said second position.

7. The fuel injector of claim 6 wherein said variable area valve member defines at least a portion of at least one additional flow passage; and said relatively unrestricted flow area includes a combination of said flow passage and said at least one additional flow passage.

8. The fuel injector of claim 7 wherein said at least one additional flow passage includes an annular flow area between said variable area valve member and said injector body.

9. The fuel injector of claim 7 wherein said at feast one additional flow passage is defined by said variable area valve member.

10. The fuel injector of claim 7 wherein said injector body includes a valve seat; and said variable area valve member being in contact with said valve seat when in said first position, but being out of contact with said valve seat when in said second position.

11. The fuel injector of claim 10 wherein said valve seat is one of a flat valve seat and a conical valve seat.

12. The fuel injector of claim 2 wherein said orifice member includes an opening hydraulic surface exposed to fluid pressure in an upstream portion of said needle control passage.

13. The fuel injector of claim 1 wherein said orifice member remains stationary when said needle valve member moves from said dosed position toward said open position.

14. The fuel injector of claim 1 wherein said orifice member remains stationary when said needle valve member moves from said open position toward said closed position.

15. A method of injecting fuel, comprising the steps of:

opening a nozzle outlet slowly at least in part by displacing fluid, which is caused by movement of a needle valve member, through a restricted flow passage defined by an orifice member that has a minimum flow area along its length, which is a restricted flow area; and closing said nozzle outlet quickly at least in part by displacing fluid toward a closing hydraulic surface of said needle valve member through an unrestricted flow passage with a minimum flow area along its length, which is an unrestricted flow area relative to said restrictive flow area, and said unrestricted flow passage includes the restricted flow passage and at least one other flow passage defined at least in part by said orifice member.

16. The method of claim 15 including a step of biasing said orifice member toward a first position; and biasing said needle valve member toward a closed position.

17. The method of claim 16 wherein said biasing steps are accomplished with a common biaser.

18. The method of claim 15 wherein said opening step includes moving said orifice member from a first position to a second position.

19. The method of claim 15 wherein said closing step includes a step of moving said orifice member from a restricted position to an unrestricted position.

20. The method of claim 15 including a step of increasing fuel pressure at said nozzle outlet for a majority of time between said opening step and said closing step.

* * * * *

UNITED STATES PATENT AND TRADEMARK OFFICE

CERTIFICATE OF CORRECTION

PATENT NO. : 7,124,744 B2
APPLICATION NO. : 10/631291
DATED : October 24, 2006
INVENTOR(S) : Norval J. Weimken et al.

It is certified that error appears in the above-identified patent and that said Letters Patent is hereby corrected as shown below:

In claim 1, Column 15, line 9 and 16, please correct the spelling of the word lenght to --length--.

In claim 13, Column 16, line 26, please correct the spelling of the word dosed to --closed--.

Signed and Sealed this

Twenty-second Day of July, 2008

JON W. DUDAS
*Director of the United States Patent and Trademark Office*